US010434426B2

(12) United States Patent
Cordray

(10) Patent No.: US 10,434,426 B2
(45) Date of Patent: Oct. 8, 2019

(54) SWING

(71) Applicant: Quality Innovative Products, LLC, Akron, OH (US)

(72) Inventor: Gregory Cordray, Akron, OH (US)

(73) Assignee: Quality Innovative Products, LLC, Akron, OH (US)

( * ) Notice: Subject to any disclaimer, the term of this patent is extended or adjusted under 35 U.S.C. 154(b) by 0 days.

(21) Appl. No.: 15/262,669

(22) Filed: Sep. 12, 2016

(65) Prior Publication Data

US 2017/0065897 A1 Mar. 9, 2017

Related U.S. Application Data

(63) Continuation of application No. 14/685,561, filed on Apr. 13, 2015, now Pat. No. 9,440,154, which is a (Continued)

(51) Int. Cl.

| | |
|---|---|
| ***A63G 9/00*** | (2006.01) |
| ***A63G 9/12*** | (2006.01) |
| *A47D 13/00* | (2006.01) |

(52) U.S. Cl.

CPC ..... *A63G 9/00* (2013.01); *A63G 9/12* (2013.01)

(58) Field of Classification Search

CPC ... A63G 9/00; A63G 9/12; A63G 9/14; A47D 13/00; A47D 13/107; A47D 1/00; A47D 1/10

(Continued)

(56) References Cited

U.S. PATENT DOCUMENTS 2,701,604 A * 2/1955 St Louis ..... A47D 13/105 472/125
3,130,969 A * 4/1964 Groth ..... A63G 9/02 297/273

(Continued)

FOREIGN PATENT DOCUMENTS

DE 93 05 030.5 7/1993
DE 203 01 452 U1 4/2003

(Continued)

OTHER PUBLICATIONS

Super Spinner Facebook Posts (1 page total) dated Jan. 31, 2014 (pre-order) and Mar. 26, 2014 (upcoming product shipment announcement) made by the Applicant of the present application U.S. Appl. No. 15/262,669 and currently believed to be related to the product shown in Figs. 16-19 of the present U.S. Appl. No. 15/262,669.

(Continued)

*Primary Examiner* — Kien Nguyen
(74) *Attorney, Agent, or Firm* — Fay Sharpe LLP

(57) ABSTRACT

A swing includes a body including a concave central portion including an upper surface defining a recessed seat adapted to support a user, a lower surface that is on an opposite side of the central portion as compared to the upper surface, and a peripheral edge surrounding the concave central portion. The peripheral edge includes a plurality of tether openings, and a tether system is engaged with the plurality of tether openings. A first tether section of the tether system extends between first and second ones of the tether openings along the lower surface of the body, and a second tether section of the tether system extends between third and fourth ones of the tether openings along the lower surface of the body, such that the first and second sections of the tether system support the central portion of said body.

20 Claims, 21 Drawing Sheets

Related U.S. Application Data continuation-in-part of application No. 13/909,072, filed on Jun. 3, 2013, now Pat. No. 9,067,146, which is a continuation-in-part of application No. 12/850,696, filed on Aug. 5, 2010, now Pat. No. 8,454,450.

(60) Provisional application No. 61/273,492, filed on Aug. 5, 2009.

(58) Field of Classification Search
USPC ..... 472/118–125; 297/273, 274
See application file for complete search history.

(56) References Cited

U.S. PATENT DOCUMENTS

| | | | | | |
|---|---|---|---|---|---|
| 3,145,990 | A * | 8/1964 | Prouty | A63G 23/00 | 297/247 |
| 3,261,607 | A * | 7/1966 | Horowitz | A63G 9/00 | 297/463.2 |
| 3,937,463 | A * | 2/1976 | Soisson | A63G 9/00 | 24/129 D |
| 4,014,540 | A * | 3/1977 | Caulkins | A63G 9/12 | 248/341 |
| D259,652 | S | 6/1981 | Ahrens | | |
| 4,731,280 | A | 3/1988 | Geisseler | | |
| 4,978,120 | A * | 12/1990 | Greenwood | A63G 1/20 | 297/274 |
| 5,067,706 | A * | 11/1991 | Tsai | A63G 9/00 | 472/118 |
| 5,116,565 | A | 5/1992 | Yoshino | | |
| 5,149,117 | A * | 9/1992 | Wilkens, Sr. | B62B 13/00 | 280/18.1 |
| D336,378 | S | 6/1993 | Kittridge | | |
| 5,292,024 | A | 3/1994 | Koefelda et al. | | |
| 5,342,245 | A * | 8/1994 | Webb, Jr. | A63G 9/00 | 472/118 |
| 5,427,575 | A * | 6/1995 | Berk | A63G 9/00 | 297/273 |
| 5,887,944 | A * | 3/1999 | Boost | A47D 13/102 | 297/258.1 |
| 5,997,403 | A * | 12/1999 | Fonti | A63B 19/04 | 472/131 |
| 6,572,483 | B1 * | 6/2003 | Hoffman | A63G 9/00 | 472/118 |
| 6,702,686 | B1 * | 3/2004 | Brown | A63G 9/12 | 472/118 |
| 6,874,851 | B2 * | 4/2005 | Hoffmann | A63B 27/00 | 297/273 |
| 6,945,919 | B2 | 9/2005 | Yang | | |
| 7,175,535 | B1 * | 2/2007 | Marmentini | A47D 13/025 | 297/273 |
| 7,300,355 | B1 * | 11/2007 | Hense | A63G 9/12 | 472/118 |
| 8,454,450 | B1 * | 6/2013 | Cordray | A63G 9/00 | 472/118 |
| 9,067,146 | B1 * | 6/2015 | Cordray | A63G 9/00 | |
| 2005/0107173 | A1 * | 5/2005 | Pelletier | A63G 9/12 | 472/118 |

FOREIGN PATENT DOCUMENTS

| | | |
|---|---|---|
| GB | 1 533 495 | 11/1978 |
| WO | WO 2007/019861 A2 | 2/2007 |

OTHER PUBLICATIONS

Slackers/Ripline Sky Saucer Swing (3 pages) purporting to show a swing product introduction on Jun. 12, 2014 with tether channels under the central portion of a swing body.

Drawing of Playground Swing, Date—Unknown.

Drawing of Tire Swing, Date—Unknown.

Photograph of Archaeological Museim in Herakleion, Greece. Woman sitting on a swing. Agia Triada, Late New Palace period, 1450-1300 B.C.

Photograph of Red figured chous. Anthesteria. A man prepares to leave a child on a swing. By the Eretria Painter. Probably from Koropi. http://www.namuseum.gr/collections/vases/class ical/classic09-en.html, 435-420 B.C.

Hamper, Chris, Pearson Baccalaureate Higher Level Physics 100-07, Pearson Educ. Limited, 2009.

Edgar, Ray, "Swings: they do mean a thing or two, as MPavilion demonstrates," The Sydney Morning Hearld, Dec. 16, 2017, https://www.smh.com.au/entertainment/art-and-design/swings-they-do-mean-a-thing-or-two-as-mpavilion-demonstrates-20171214-h04r7k.html.

Rybcynski, Witold, Now I Sit Me Down: From Klismos to Plastic Chair: A Natural History (2016).

Excerpts of *Rosato's Plastics Encyclopedia* & Dictionary, 1993.

Letter regarding litigation proceeding filed in the US. District Court—District of Colorado on Feb. 14, 2018 and assigned Case No. 1:18-cv-00369-NYW.

Pendrill, Ann-Marie et al., "Swing and slides", Special Feature: All the Fun of the Fair, www.iop.org/journals/physed, pp. 527-533, Nov. 2005.

Autism Index Sensory Swings (4 pages)—Copyright 2004-2018.

* cited by examiner

SWING

CROSS-REFERENCE TO RELATED APPLICATIONS

This application is a continuation of U.S. application Ser. No. 14/685,561 filed Apr. 13, 2015, now assigned U.S. Pat. No. 9,440,154, which is a continuation-in-part of U.S. application Ser. No. 13/909,072 filed Jun. 3, 2013, now assigned U.S. Pat. No. 9,067,146, which is a continuation-in-part of U.S. application Ser. No. 12/850,696 filed Aug. 5, 2010, now assigned U.S. Pat. No. 8,454,450, which claims priority from and benefit of the filing date of U.S. provisional patent application Ser. No. 61/273,492 filed Aug. 5, 2009, and the entire disclosure of each of said prior applications is hereby expressly incorporated by reference into the present specification.

BACKGROUND

There are generally two types of swings that are known for use with swing sets or with other playground installations and/or is a residential setting: (i) conventional rectangular rigid swing seats or flexible strap-like swing seats meant to move on an arc in a back-and-forth motion; or (ii) tire swings that use a vehicle tire or like structure and that can twist and swing in any direction such as diagonal, circular, etc. These prior swings require the child or other user to pump his or her legs or otherwise shift their weight to move the swing, and require the user to maintain a sitting position and hold onto the swing or the rope(s) or chain(s) by which the swing is suspended. As such, these known swings have been found to have limited entertainment and enjoyment for certain children and other users that are not capable of maintaining the proper position on the swing and/or that are not capable of controlling the motion of the swing in the manner intended and required.

Furthermore, these prior swings and others have been found to be deficient for a wide variety of other reasons including ease of manufacture, ease of installation, ease of use, durability, variety of modes of operation, safety, and other such attributes. As such, a need has been found for a new and improved swing.

SUMMARY

In accordance with a first aspect of the present development, a swing includes a body including a concave central portion including an upper surface defining a recessed seat adapted to support a user, a lower surface that is on an opposite side of the central portion as compared to the upper surface, and a peripheral edge surrounding the concave central portion. The peripheral edge includes a plurality of tether openings, and a tether system is engaged with the plurality of tether openings. A first tether section of the tether system extends between first and second ones of the tether openings along the lower surface of the body, and a second tether section of the tether system extends between third and fourth ones of the tether openings along the lower surface of the body, such that the first and second sections of the tether system support the central portion of said body.

In accordance with another aspect of the present development, a swing includes a body including a concave central portion including an upper surface defining a recessed seat adapted to support a user, a lower surface that is on an opposite side of the central portion as compared to the upper surface, and a peripheral edge surrounding the concave central portion. The peripheral edge includes a plurality of tether openings. A tether system is engaged with the plurality of tether openings. A first tether section of said tether system extends between first and second ones of the tether openings adjacent the lower surface of said body, and a second tether section of the tether system extends between third and fourth ones of the tether openings adjacent the lower surface of the body, such that the first and second sections of the tether system contact the body in the region of the lower surface and support the central portion of the body.

In accordance with another aspect of the present development, a swing body includes a concave central portion including an upper surface defining a recessed seat adapted to support a user, a lower surface that is on an opposite side of the central portion as compared to the upper surface, and a peripheral edge surrounding the concave central portion. The peripheral edge includes a plurality of tether openings adapted to receive an associated tether system. The body further includes first and second tether channels located adjacent the lower surface of the body and configured to receive respective first and second tether sections of the associated tether system, wherein the first tether groove defines a first path that extends between first and second ones of the tether openings and the second tether groove defines a second path that extends between third and fourth ones of the tether openings.

DETAILED DESCRIPTION

Figure 1A:
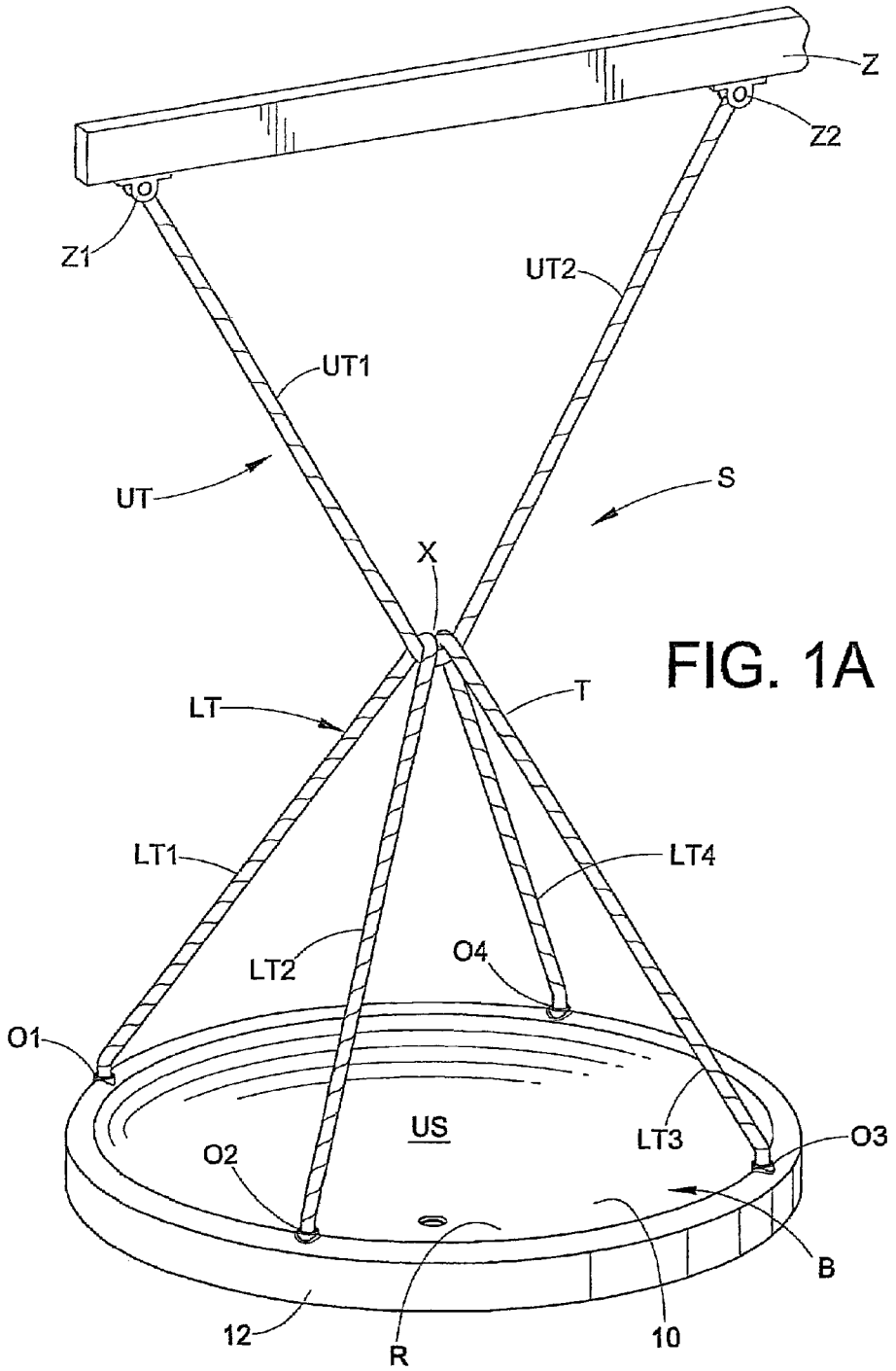
FIG. 1A shows a swing system in accordance with the present development, wherein the tether system thereof is arranged in a first configuration.

FIG. 1A shows a swing system S in accordance with the present development. The swing system S includes a swing body B and a tether system T that is adapted to suspend the swing body from a support structure Z such that the swing body B is free to swing in any direction including back-and-forth, sideways, diagonal, circular, etc. and such that the swing body can twist. As shown, the tether system T includes an upper portion UT comprising two upper tethers UT1U,T2 and a lower portion LT comprising at least four lower tethers LT1,LT2,LT3,LT4. The lower tethers LT1-LT4 can be defined from a single length or multiple separate lengths of rope or chain or other flexible member(s), and the upper tethers UT1, UT2 can likewise be defined from a single length or two separate lengths of rope or chain or other flexible member(s), and the entire tether system T can be provided by a single length of rope, chain, or other tether members. FIG. 1A shows an arrangement in which the respect lower ends of the lower tethers LT1-LT4 are each connected to the swing body B, and the upper ends of the lower tethers LT1-LT4 converge to and are joined at an apex X such that the lower tethers LT1-LT4 define a cone shape. The lower ends of the upper tethers UT1,UT2 are each connected to the upper ends of the lower tethers LT1-LT4 at the apex X, and the upper ends of the upper tethers UT1,UT2 are adapted to be connected to the support structure Z at respective locations Z1,Z2 that are spaced-apart from each other. In an alternative embodiment, the tether system T includes only one of the upper tethers UT1 or UT2 that extends between the apex X and a single connecting location on the support structure Z.

Figure 1B:
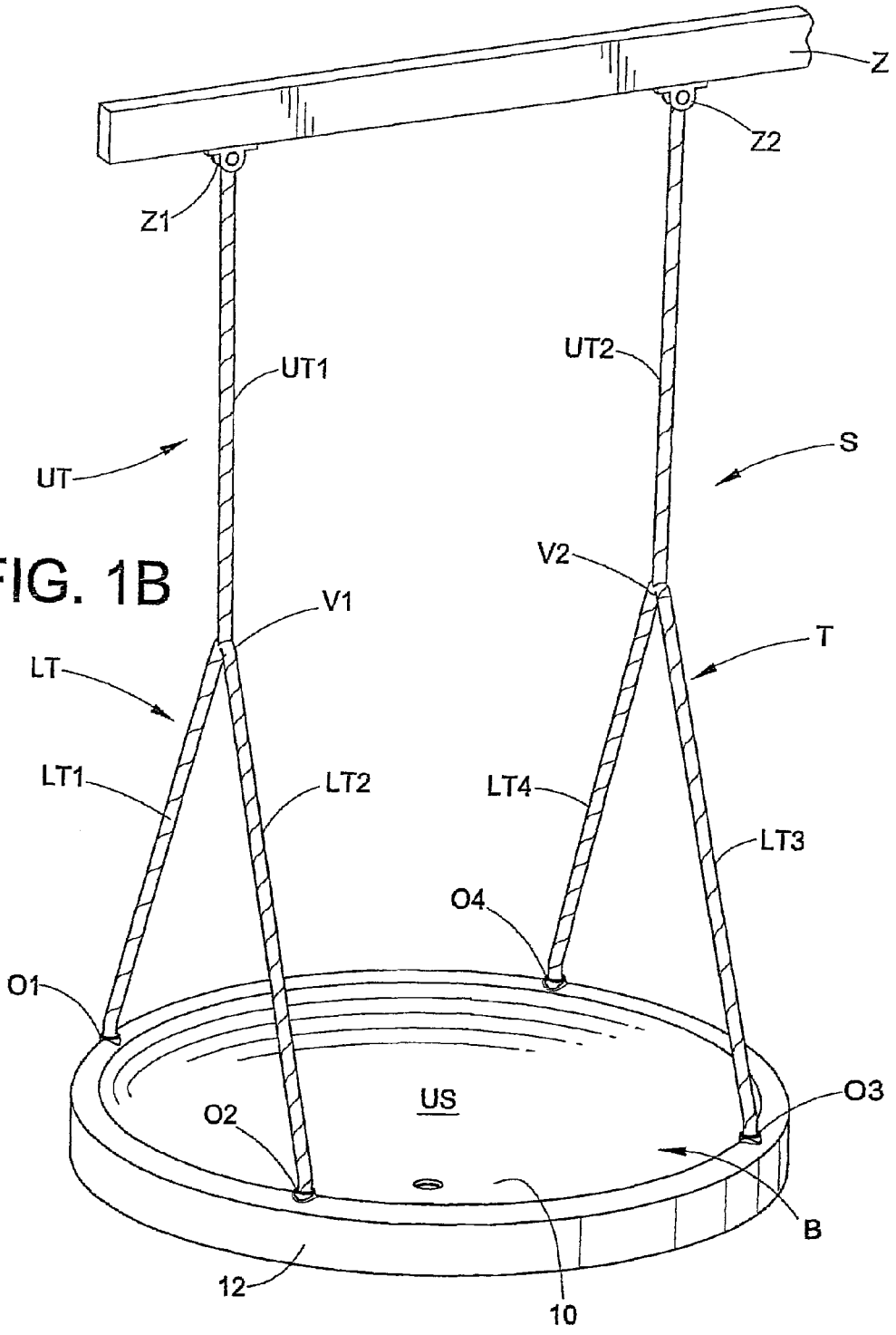
FIG. 1B shows a swing system in accordance with the present development, wherein the tether system thereof is arranged in a second configuration.

FIG. 1B shows another alternative arrangement for the tether system T in which the upper ends of the first and second lower tethers LT1,LT2 are joined at a first vertex V1 such that a first triangle is defined by the first and second lower tethers LT1,LT2, and the upper ends of the third and fourth lower tethers LT3,LT4 are joined at a second vertex V2 such that a second triangle is defined by the third and fourth lower tethers LT3,LT4. In this case, the first and second upper tethers UT1,UT2 are connected respectively to the first and second vertices V1,V2. In such an arrangement, the swing system S is configured to swing predominantly in a back-and-forth manner with the upper tethers UT1,UT2 moving in respective planes that are vertical or inclined.

Figure 1C:
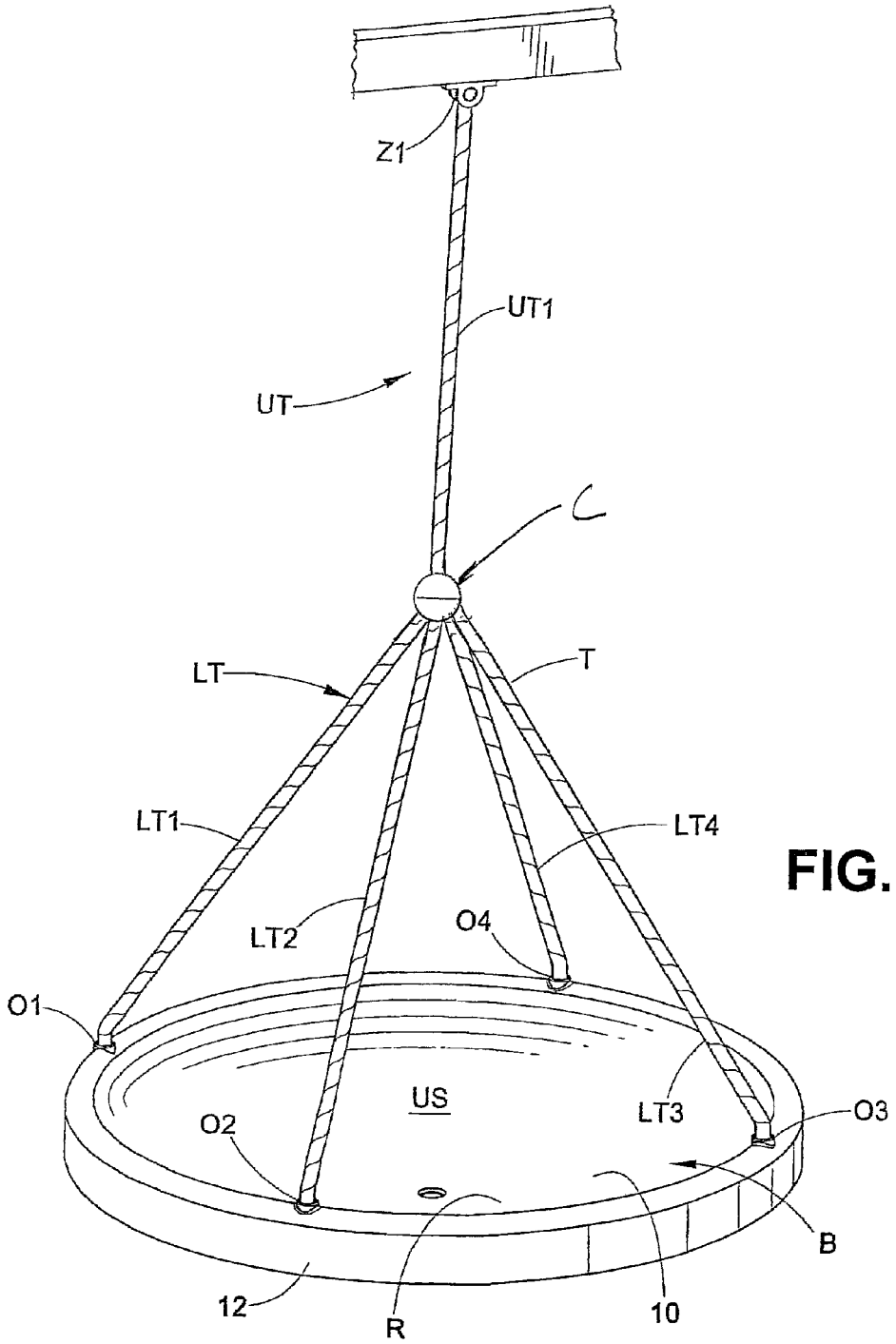
FIG. 1C shows a swing system in accordance with the present development, wherein the tether system thereof is arranged in a third configuration.
Figure 2:
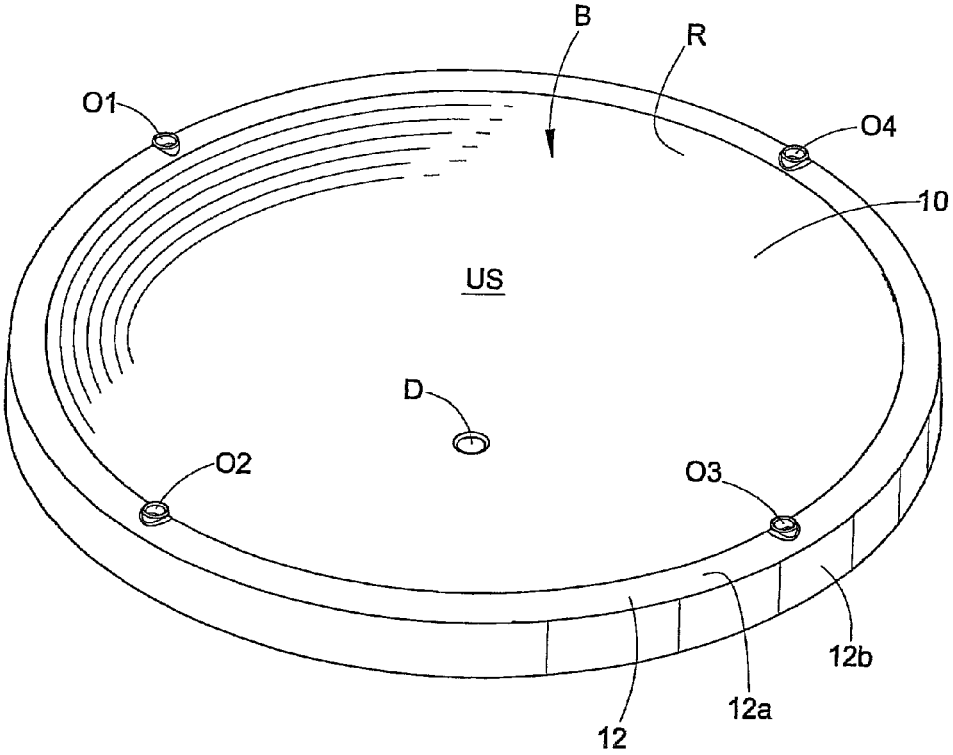
FIG. 2 is an isometric view of a swing body of the swing system of FIGS. 1A and 1B.
Figure 3:
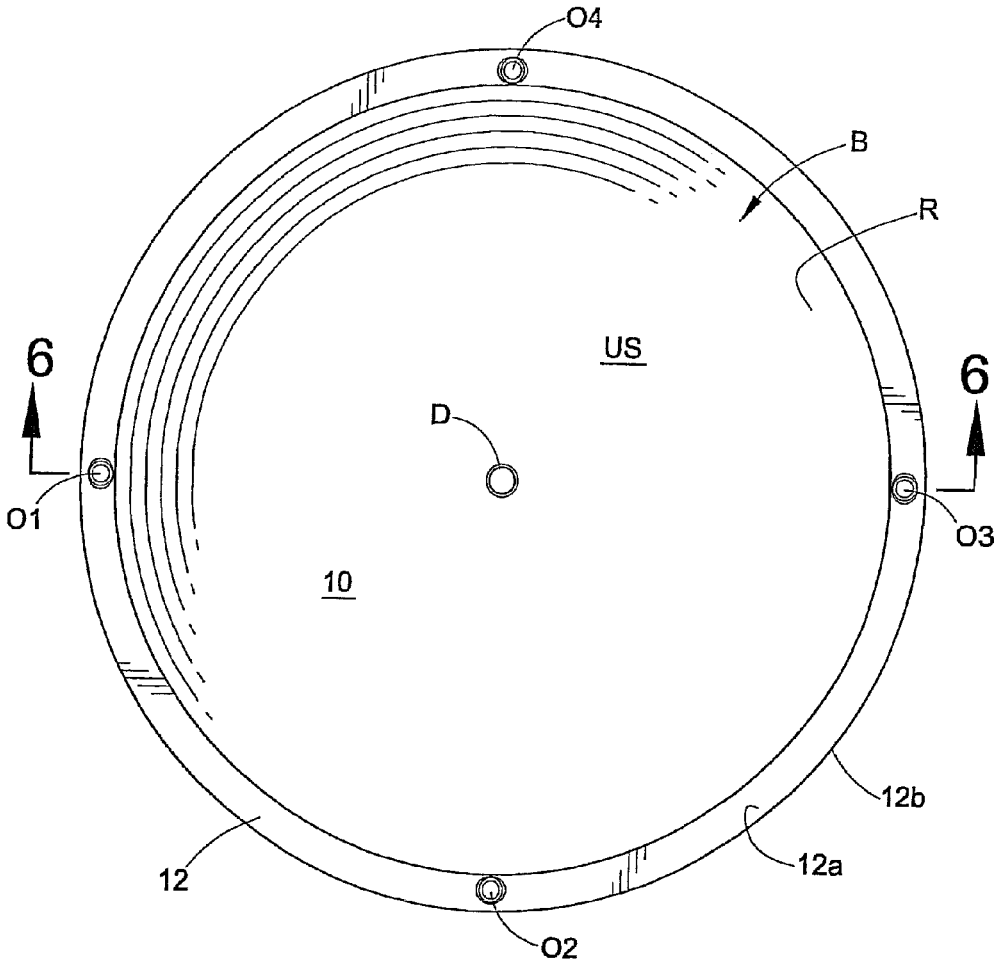
FIG. 3 is a top view of the swing body of FIG. 2.
Figure 4:
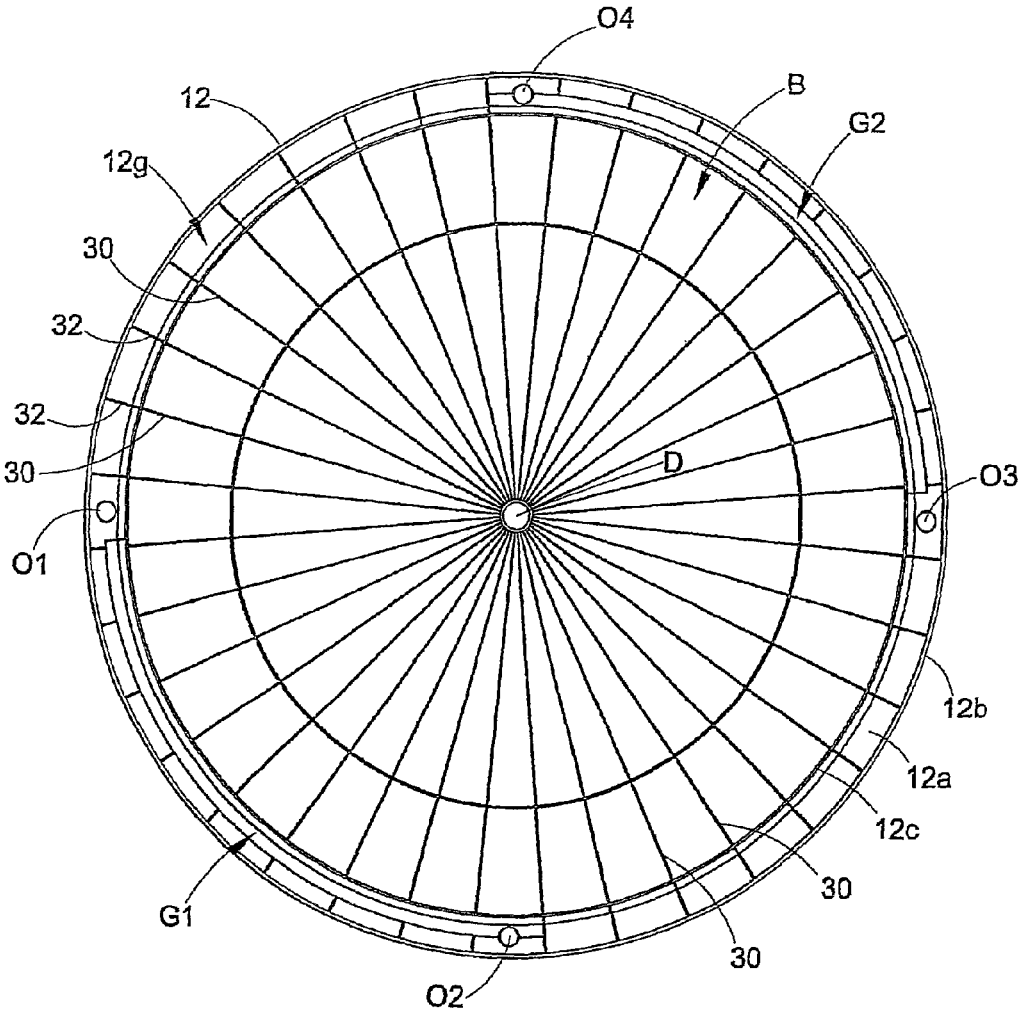
FIG. 4 is a bottom view of the swing body of FIG. 2.
Figure 5:
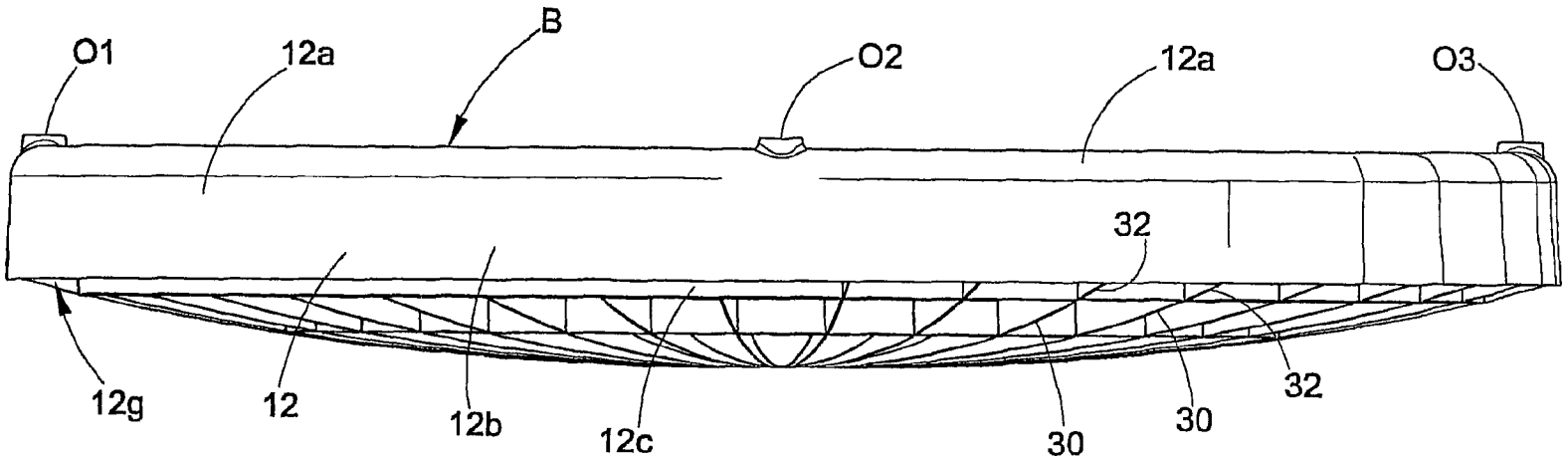
FIG. 5 is a side view of the swing body of FIG. 2.
Figure 6:
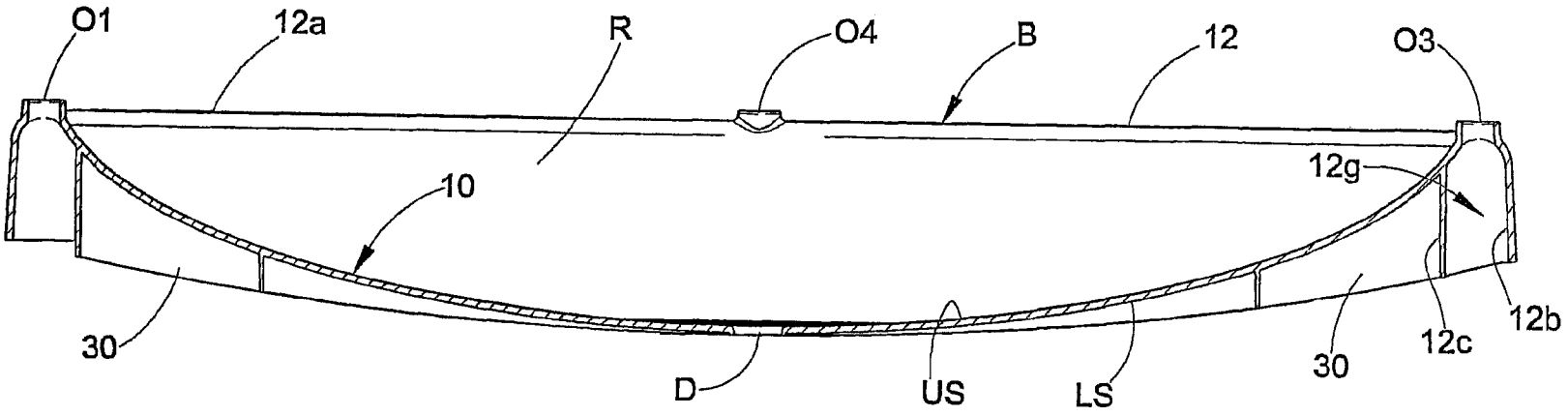
FIG. 6 is a section view taken at line 6-6 of FIG. 3.

FIG. 1C shows another alternative arrangement for the tether system T in which the upper ends of all four lower tethers LT1,LT2,LT3,LT4 are brought together and connected to a coupling C which can be, e.g., a non-swivel coupling or a swivel coupling. In the embodiment illustrated in FIG. 1C, a single upper tether UT1 is connected to all four lower tethers LT1-LT4 via coupling C, or the coupling C can be omitted and a knot or other means can be used to secure the single upper tether UT1 directly to all four lower tethers LT1-LT4.

FIGS. 2-6 show different views of the swing body B, itself. The body B is defined as a one-piece molded polymeric construction from any suitable polymer resin material, although other materials such as metal, wood, etc. can be used instead. The swing body B includes a concave central seat portion 10 defining recess R that forms a seat and a peripheral edge 12 surrounding the concave central portion 10. The seat defined by the concave central seat portion 10 is adapted to support a user such as an infant or a child or can be dimensioned to support an adult. In one embodiment, the peripheral edge 12 of the body is circular such that the body defines a saucer or disk. In one embodiment, the body has a diameter in the range of 22 inches to 30 inches, and the recess has a maximum depth relative to the peripheral edge 12 in the range of 2.5 inches to 4 inches.

The peripheral edge 12 of the body B includes a plurality of tether openings O1, O2, O3, O4 with which the lower tethers LT1-LT4 are respectively engaged. In the illustrated embodiment, the peripheral edge 12 comprises at least four of the tether openings O1-O4 arranged symmetrically about the peripheral edge 12 such that the four tether openings O1-O4 are circumferentially spaced at 90 degree intervals from each other and such that each of said four tether openings are diametrically opposed from another one of the four tether openings.

The concave central seat portion 10 includes a drain opening D defined therein for allowing water and dirt/sand to flow by gravity from the seat recess R through the drain opening D. The drain opening D is centrally located in the central seat portion 10 so as to be equidistant from each of said four tether openings O1-O4 and so as to be located at the deepest part of the recess R.

An upper surface US of the concave central seat portion 10 is smooth for maximum comfort and to facilitate flow or water and sand toward the drain opening D. The opposite lower surface LS of the concave central seat portion 10 comprises a plurality of seat support ribs 30 extending or projecting therefrom, or the ribs 30 can be omitted. In the illustrated embodiment, the seat support ribs 30 are radial ribs, each of which extends radially outward from an inner end located adjacent the drain opening D to an outer end located adjacent the peripheral edge 12. Each of the seat support radial ribs 30 is oriented normal to said lower surface LS.

The peripheral edge 12 comprises: (i) a top wall 12*a* that extends radially outward from the outermost edge of the seat recess R; (ii) an outer circular wall 12*b* connected to and projecting downwardly from an outer end of the top wall 12*a*; and, (iii) an inner circular wall 12*c* connected to and projecting downwardly from an inner end of the top wall 12*a* such that the inner circular wall 12*c* is located radially inward from and is arranged concentrically with the outer circular wall 12*b*. As such, a peripheral groove 12*g* is defined between the outer and inner circular walls 12*b*, 12*c*.

The tether openings O1-O4 are each defined in the top wall 12*a* and each open through the top wall 12*a* into the peripheral groove 12*g*.

The body B can further comprise a plurality of optional peripheral edge support ribs 32 that each extend between and interconnect the outer and inner circular walls 12*b*, 12*c* to provide support and strength to the outer and inner circular walls 12*b*, 12*c*. The peripheral edge support ribs 32 are aligned respectively with the seat support ribs 30, such that each peripheral edge support rib 32 extends in a radial direction coincident with the seat support rib 30 with which it is aligned. The peripheral groove 12*g* comprises first and second open regions G1, G2 that extend circumferentially and that are free of the peripheral edge support ribs 32. The first open region G1 is located between the first and second tether openings O1,O2, and the second open region G2 is located between the third and fourth tether openings O3,O4. The first open region G1 is adapted to receive the rope or chain or other member that defines the first and second lower tethers LT1, LT2 and allows the rope/chain/member thereof to extend circumferentially in the peripheral groove 12*g* between and through the tether openings O1,O2 in the case where the first and second lower tethers are defined from a single rope/chain/member. The second open region G2 is adapted to receive the rope or chain or other member that defines the third and fourth lower tethers LT3, LT4 and allows the rope/chain/member thereof to extend circumferentially in the peripheral groove 12*g* between and through the tether openings O3,O4 in the case where the third and fourth lower tethers are defined from a single rope/chain/member.

Figure 7:
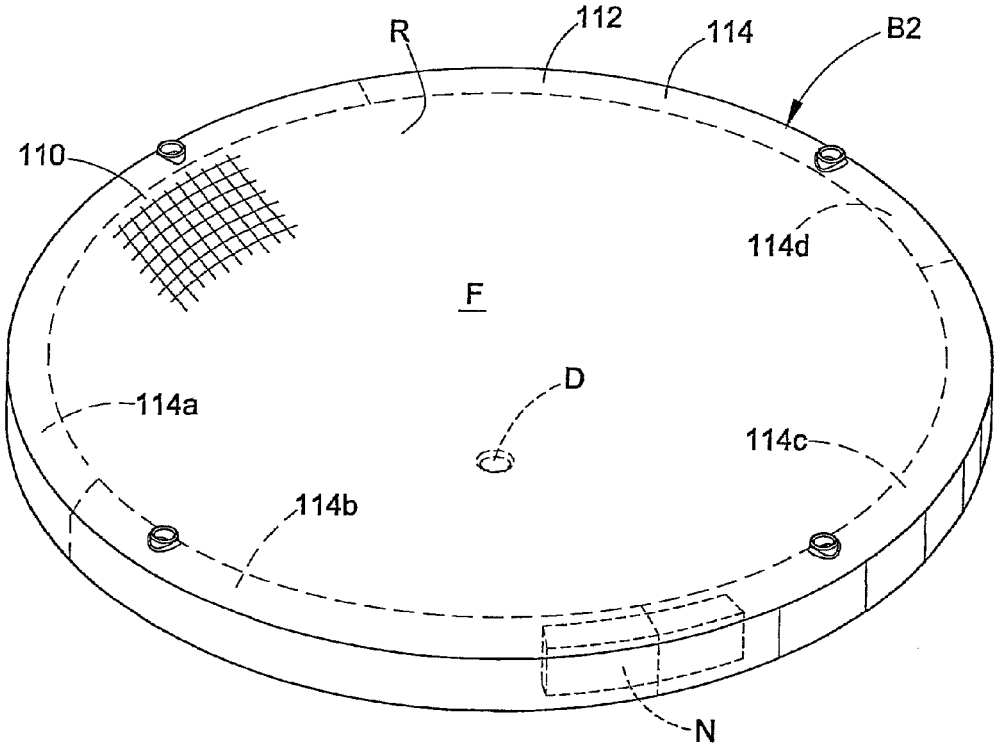
FIG. 7 shows an alternative swing body wherein the peripheral edge is defined by a one-piece or multi-piece annular ring and the recessed seat comprises a flexible fabric or other material connected to the peripheral edge.

FIG. 7 shows an alternative swing body B2 wherein the peripheral edge 112 is defined by a one-piece or multi-piece annular ring 114 (the ring sections of the optional multi-piece structure are indicated by broken lines at 114*a*, 114*b*, 114*c*, 114*d*) and wherein the recessed central seat portion 110 comprises a flexible fabric or other material F connected to the peripheral edge 112. In the case where the annular ring 114 is defined as a multi-piece structure, the ring sections 114*a*, 114*b*, 114*c*, 114*d* are connected using a suitable mechanical connection that can also include use of the lower tethers LT1-LT4 to secure each ring section 114*a*, 114*b*, 114*c*, 114*d* to its adjacent connected ring section. In one embodiment, a connector N is inserted into and frictionally engaged with the respective open ends of adjacent ring sections 114*a*, 114*b*, 114*c*, 114*d* to join adjacent ring sections as shown in FIG. 7. In one embodiment, the fabric or other material F is pervious to water and sand so the drain opening D is not included, but it can be included if desired and/or if the fabric or other material F is impervious to water and sand as shown in broken lines.

Figure 8:
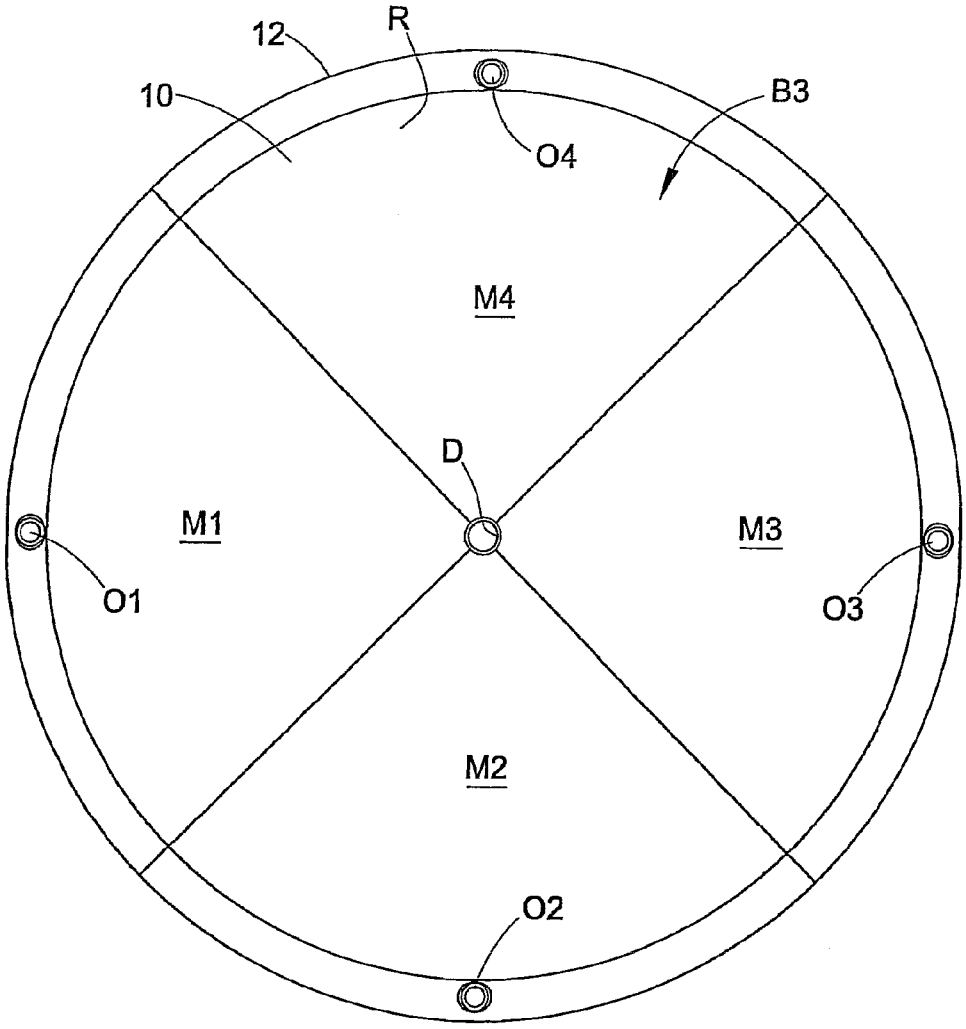
FIG. 8 shows another alternative embodiment, wherein the swing body is defined from multiple separate body members that are interconnected to construct the body.

FIG. 8 shows another alternative embodiment, wherein a swing body B3 is defined from multiple separate molded polymeric body member sections M1,M2,M3,M4 that are interconnected using a suitable mechanical connection to construct the body B3, which is otherwise identical to the body B. The body member sections M1,M2,M3,M4 are preferably each identical to each other. Here, again, the lower tethers LT1-LT4 can be used to connect adjacent connected body member sections together.

Figure 9:
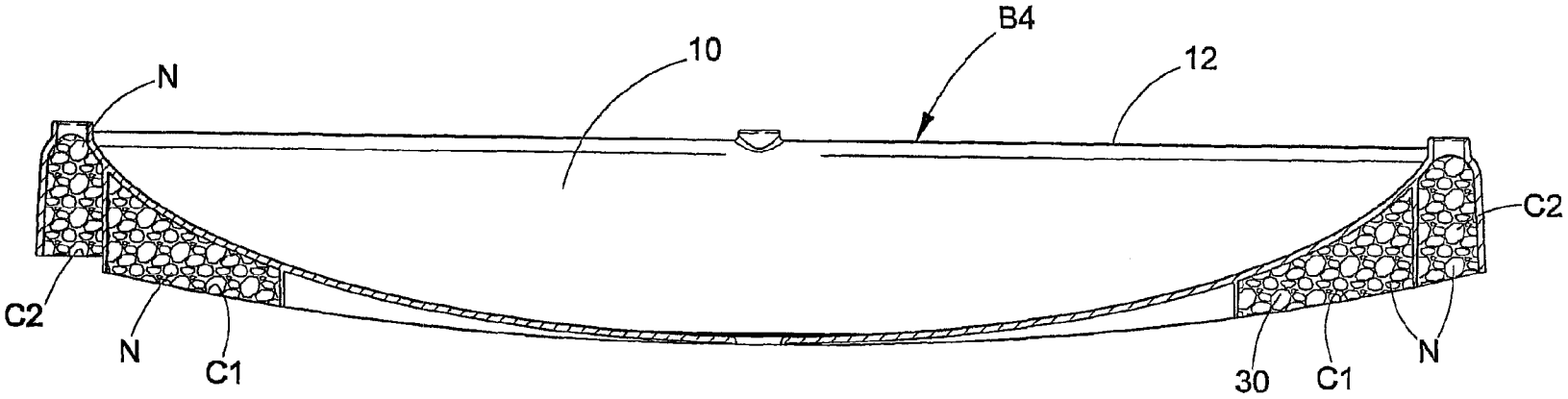
FIG. 9 shows another alternative embodiment in which a swing body includes one or more optional ballast chambers that include and/or are adapted to receive and retain a ballast material.

FIG. 9 shows another alternative embodiment in which a swing body B4 is otherwise identical to the body B but includes one or more ballast chambers M1,M2 that include and/or are adapted to receive and retain a ballast material N such as sand, water, metal weights, rocks, or any other suitable ballast material to improve the swinging performance of the swing. The ballast chamber(s) M1,M2 can be located beneath the concave central seat portion (e.g., chamber M1) and/or within the peripheral edge 12 (e.g., chamber M2). The ballast material N can permanently installed in the chambers M1,M2 or is selectively inserted into and removable from the chambers M1,M2.

Figure 10:
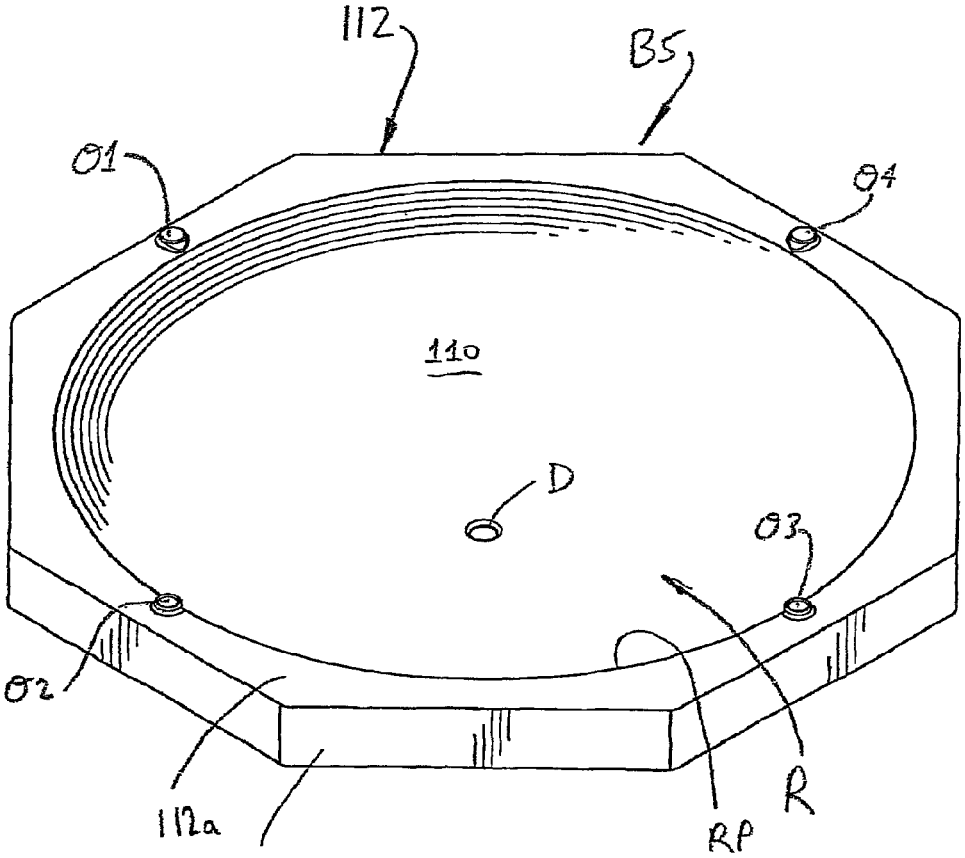
FIGS. 10 and 11 are isometric and top plan views of an alternative swing body B5 that comprises a non-rectangular polygonal peripheral edge, in which the recessed seat includes a circular peripheral or outer edge.
Figure 10A:
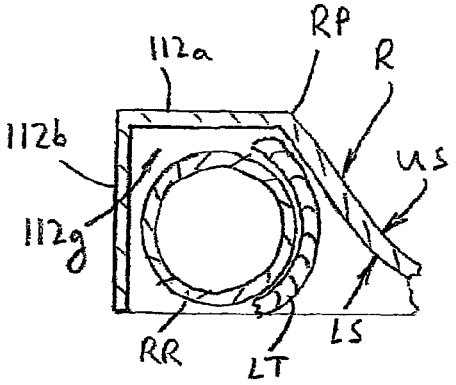
FIG. 10A is a partial section view of the swing body of FIG. 10 showing an optional reinforcement ring.
Figure 11:
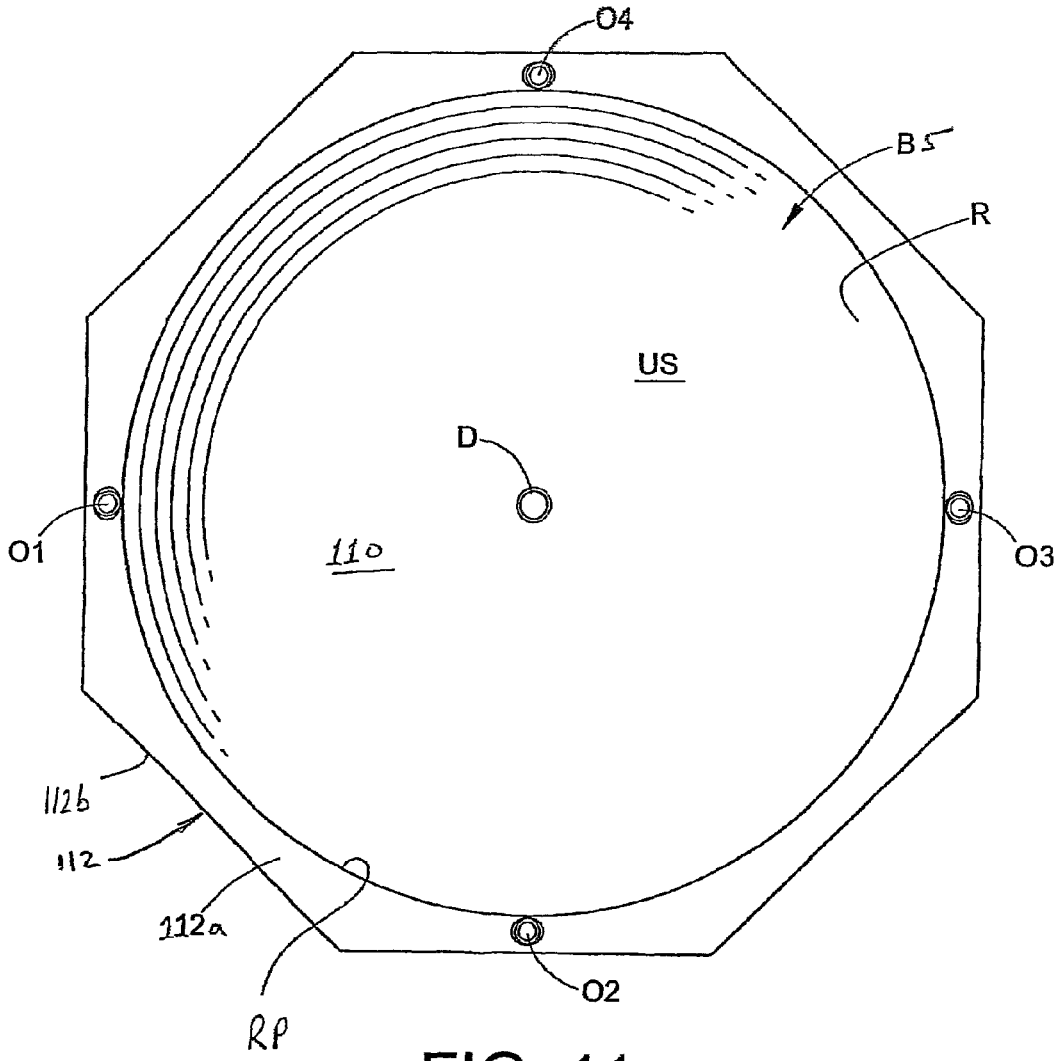

FIGS. 10 and 11 are isometric and top plan views of an alternative swing body B5 adapted for being suspended by the tether system T. Except as otherwise shown and/or described herein, the body B5 is identical to the body B described above, and like features relative to the body B are identified with like reference numbers that are 100 greater than those used in connection with the body B. The body B5 is preferably defined as a one-piece polymeric construction but is can be provided by a multi-piece assembly of polymeric and other materials. Instead of a circular peripheral wall 12 as used for the body B, the body B5 comprises a non-rectangular polygonal peripheral edge 112. As shown, the peripheral edge 112 is an octagon with 8 equal length linear sides, but the peripheral edge 112 can be defined with any other non-rectangular polygon shape using linear sides that are equal in length or unequal in length relative to each other. For example, the peripheral edge can define a trapezoid, pentagon, hexagon, octagon or other non-rectangular polygon shape. More particularly, the peripheral edge 112 comprises: (i) a top wall 112*a* that extends radially outward from the outermost or upper peripheral edge or lip RP of the seat recess R; and, (ii) an outer non-rectangular polygonal peripheral wall 112*b* connected to and projecting downwardly from an outer end of the top wall 112*a*. As shown in the section view of FIG. 10A, a peripheral groove 112*g* is defined under the top wall 112*a* adjacent the outer wall 112*b*, between the top wall 112*a*, the outer wall 112*b*, and the lower surface LS of the seat portion 110. The tether openings O1-O4 are each defined in the top wall 112*a* and each open through the top wall 112*a* into the peripheral groove 112*g*. A reinforcement ring RR defined from metal, fiber glass, wood, a polymeric material or other material is optionally located in the groove 112*g* to stiffen and strengthen the body B5, and the lower tethers LT1-LT4 (indicated generally at LT in FIG. 10A) are preferably wrapped and/or otherwise engaged with the reinforcement ring RR if the reinforcement ring is present in the groove 112*g*. In FIG. 10A, the reinforcement ring RR is shown as a tubular structure such as a metal tube. The swing body B5 is constructed such that the outer/upper peripheral edge or lip RP of the seat recess R is circular, where the seat recess R joins with the top wall 112*a*. The reinforcement ring RR can be circular as shown or can be otherwise shaped to fit in the groove 112*g*, e.g., defined in a non-rectangular polygonal shape that corresponds with the non-rectangular polygonal shape of the body peripheral wall 112*b*.

Figure 12:
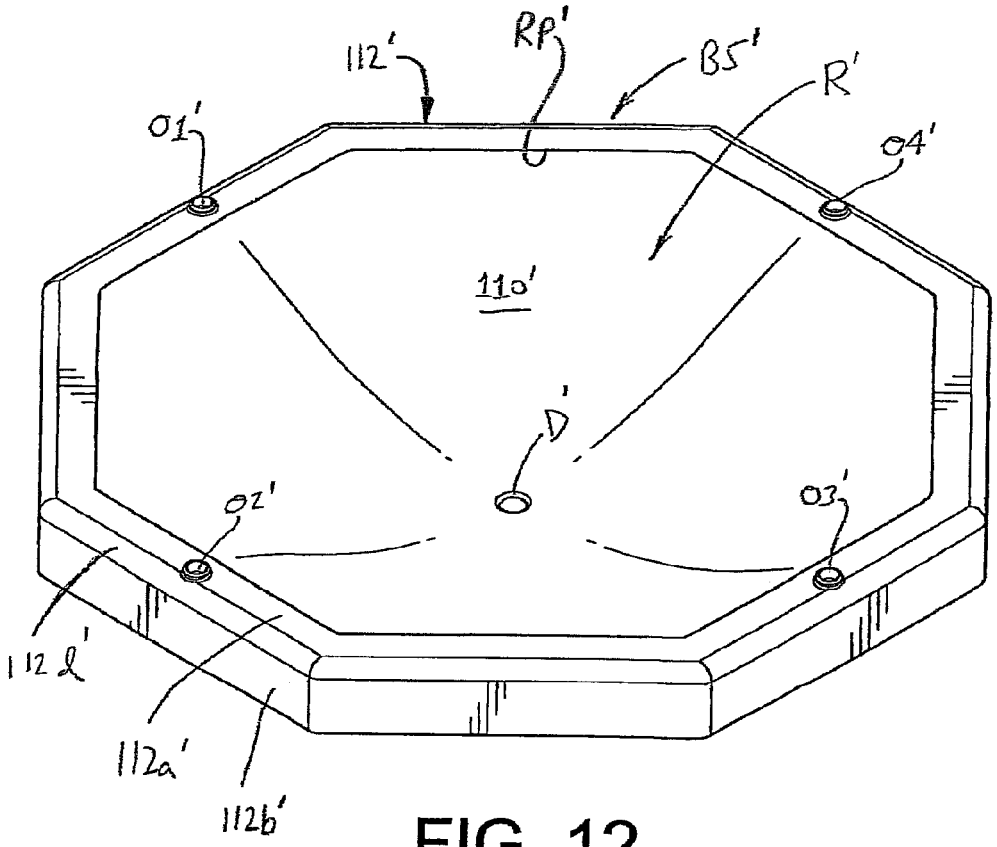
FIGS. 12 and 13 are respectively similar to FIGS. 10 and 11, but show another alternative embodiment of a swing body B6 including a non-rectangular peripheral edge, in which the recessed seat also includes a peripheral/outer edge that has a non-rectangular polygonal shape that matches the non-rectangular shape of the peripheral edge of the swing body.
Figure 13:
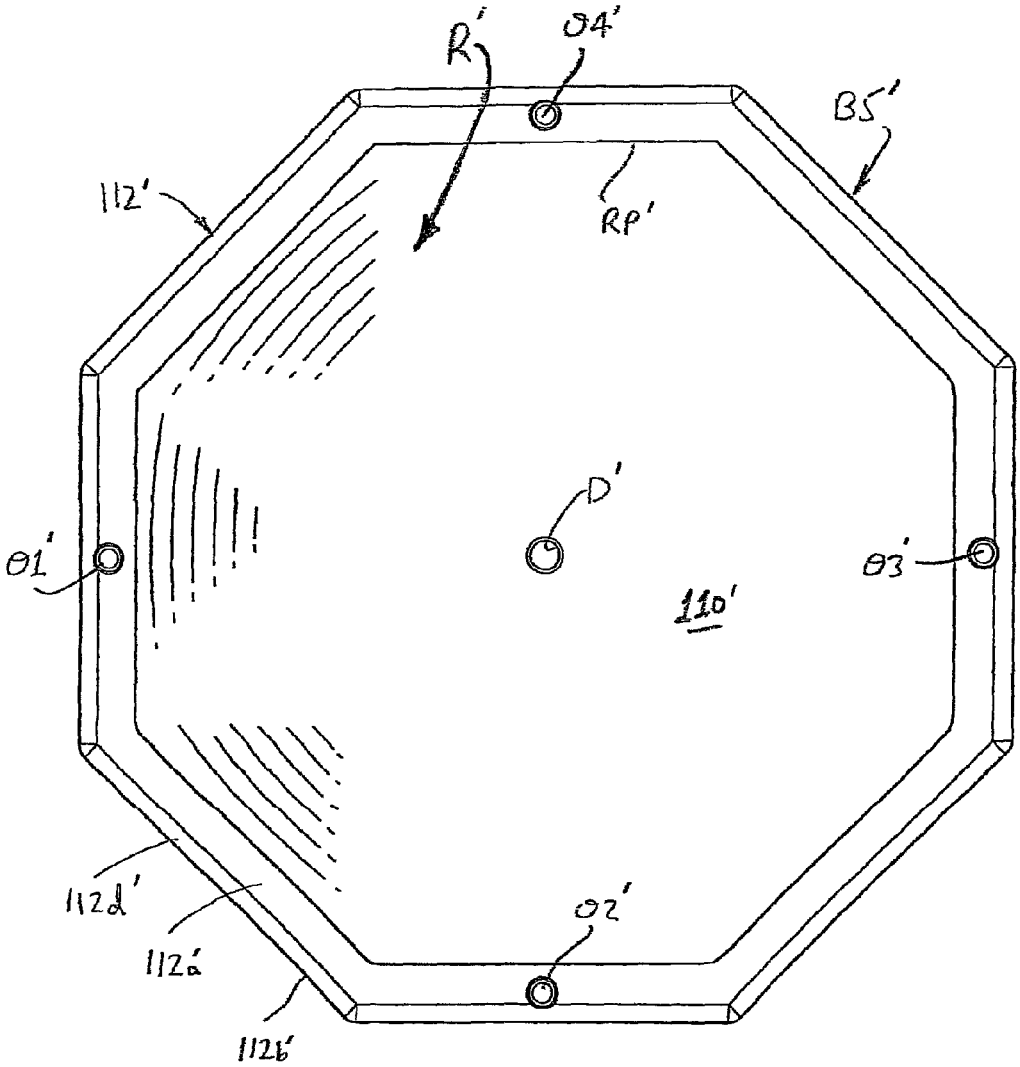

FIGS. 12 and 13 are isometric and top plan views of an alternative swing body B5' that is identical to the swing body B5 except as otherwise shown and/or described herein. Like components relative to the swing body B5 are identified with like reference numbers including a primed (') designation. With respect to the swing body B5', the outer or upper peripheral edge or lip RP' of the seat recess R' is defined to have a non-rectangular polygonal shape that corresponds to the non-rectangular polygonal shape of the peripheral wall 112*b*'. Also, the swing body B5' includes a beveled or rounded transition wall 112*d*' that joins the top wall 112*a*' of the peripheral edge 112' to the outer wall 112*b*', and this transition wall 112*d*' provides added comfort to a user when moving onto and off of the recess R of the seat portion 110'.

Figure 14:
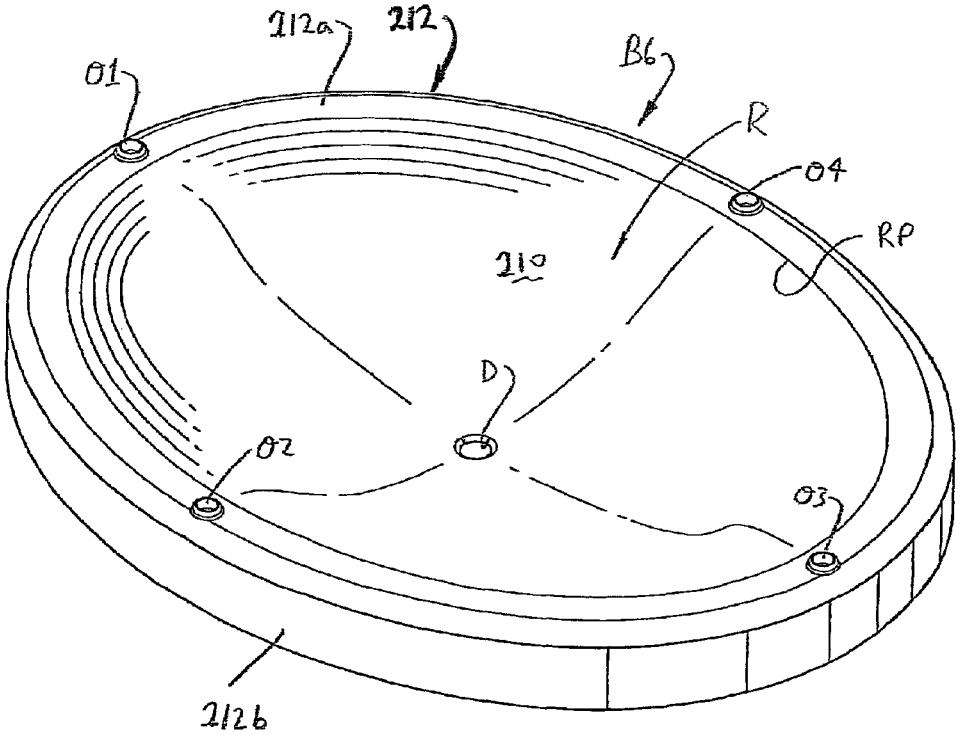
FIGS. 14 and 15 are isometric and top plan views that show another alternative embodiment of a swing body B7 formed in accordance with the present development, in which the swing body comprises an oval peripheral edge and in which the recessed seat is correspondingly ovalized so that the peripheral or outer edge of the recessed seat is shaped to correspond with the oval peripheral edge of the swing body.
Figure 14A:
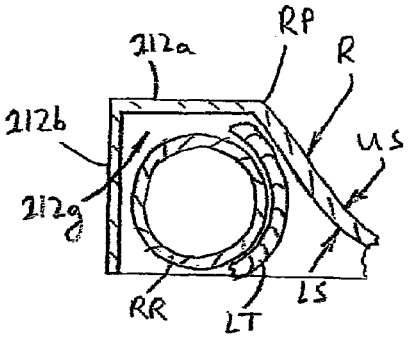
FIG. 14A is a partial section view of the swing body of FIG. 14 showing an optional reinforcement ring.
Figure 15:
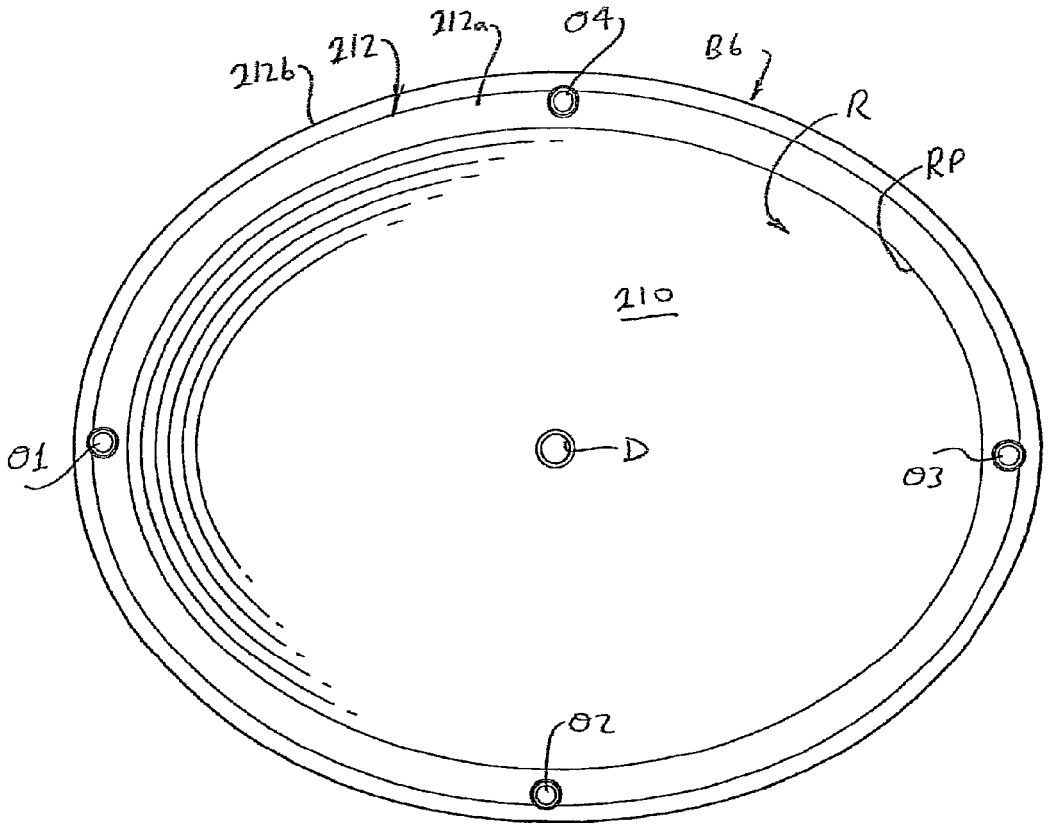
Figure 16:
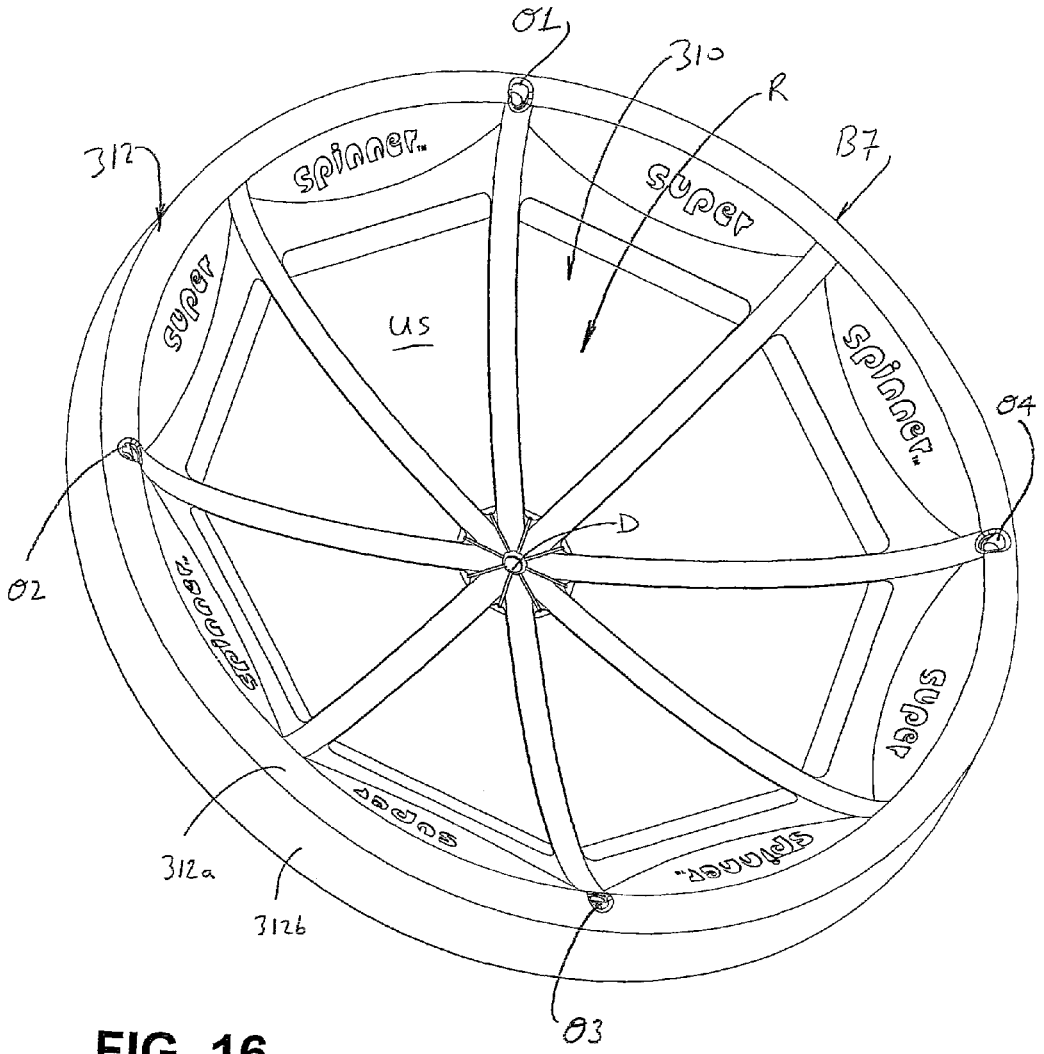
FIG. 16 is a top isometric view of another alternative embodiment of a swing body formed in accordance with the present development.
Figure 17:
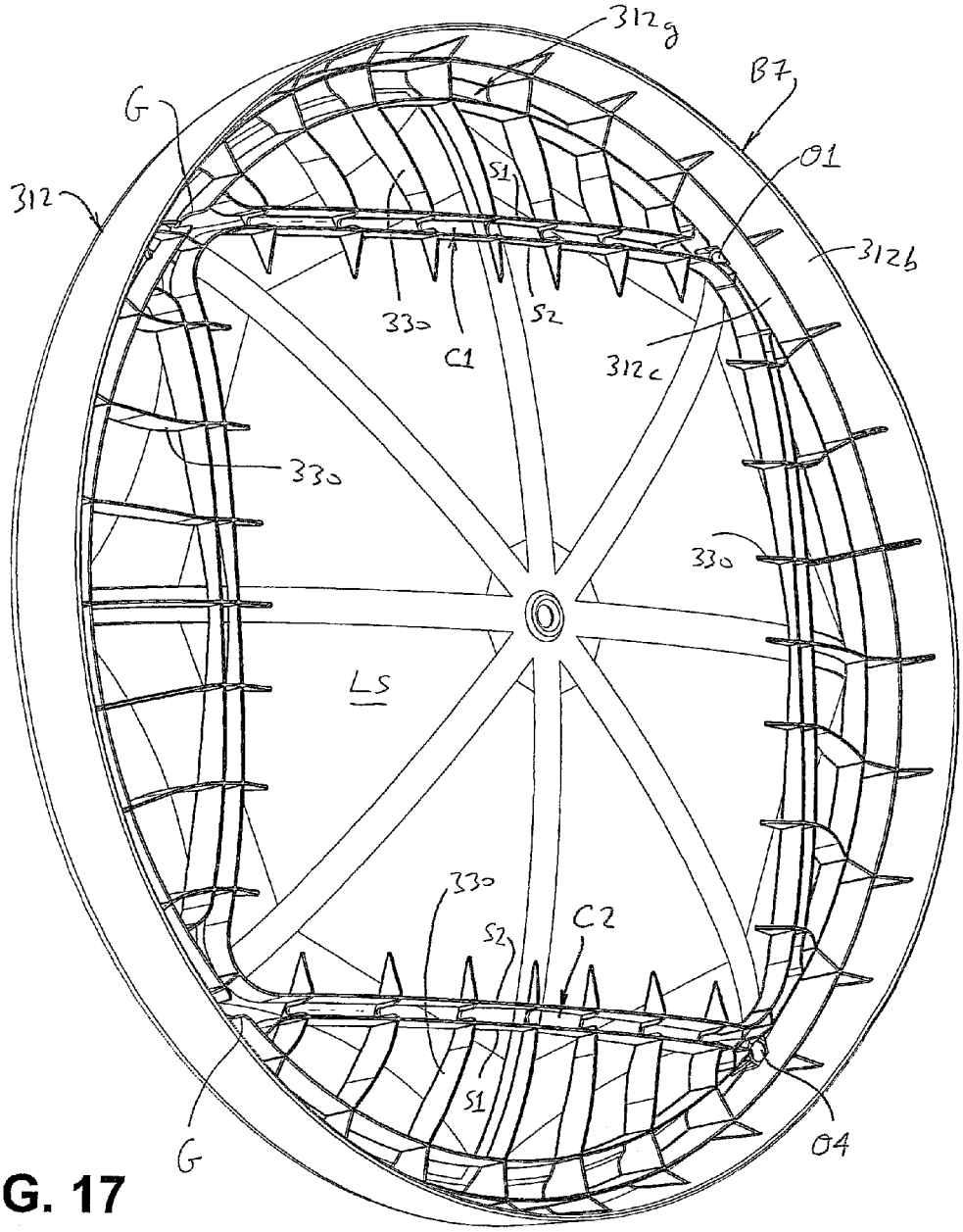
FIG. 17 is a bottom isometric view of the swing body of FIG. 16.

FIGS. 14 and 15 illustrate another alternative embodiment of a swing body B6 formed in accordance with the present development and adapted for being suspended by the tether system T. Except as otherwise shown and/or described herein, the body B6 is identical to the body B described above, and like features relative to the body B are identified with like reference numbers that are 200 greater than those used in connection with the body B. The body B6 is defined as a one-piece molded polymeric construction or is assembled from separate polymeric and/or other structures. Instead of a circular peripheral wall 12 as used for the body B, the body B6 comprises a non-circular curved peripheral wall 212. As shown, the peripheral wall 212 defines an oval, but the peripheral wall 212 can be defined with any other non-circular curved shape. More particularly, the peripheral wall 212 comprises: (i) a top wall 212*a* that extends radially outward from the outermost or upper peripheral edge or lip RP of the seat recess R; and, (ii) an outer oval or otherwise non-circular curved peripheral wall 212*b* connected to and projecting downwardly from an outer end of the top wall 212*a*. As shown in the section view of FIG. 14A, a peripheral groove 212*g* is defined under the top wall 212*a* adjacent the outer wall 212*b*, between the top wall 212*a*, the outer wall 212*b*, and the lower surface LS of the seat portion 210. The tether openings O1-O4 are each defined in the top wall 212*a* and each open through the top wall 212*a* into the peripheral groove 212*g*. A reinforcement ring RR defined from metal, fiber glass, wood, a polymeric material or other material is optionally located in the groove 212*g* to stiffen and strengthen the body B5, and the lower tethers LT1-LT4 (indicated generally at LT in FIG. 14A) are preferably wrapped and/or otherwise engaged with the reinforcement ring RR if the reinforcement ring is present in the groove 212*g*. In FIG. 14A, the reinforcement ring RR is shown as a tubular structure such as a metal tube. The swing body B6 is constructed such that the outer/upper peripheral edge or lip RP of the seat recess R is defined to match or correspond to the shape of the outer peripheral wall 212*b*, i.e., the outer/upper peripheral edge or lip RP of the recess R is defined to be oval in the illustrated embodiment. The reinforcement ring RR also defines a shape so that it fits in the groove 212*g* and, as such, the reinforcement ring RR is oval shaped in the illustrated embodiment.

FIGS. 16-19 show a swing body B7 formed in accordance with another alternative embodiment of the present development. The swing body B7 is identical to the swing body B except as otherwise shown and/or described herein and, as such, like components of the swing body B7 relative to the swing body B are identified with like reference numbers that, in some cases, are 300 greater than those used in relation to the swing body B.

The swing body B7 is defined as a one-piece molded polymeric construction from any suitable polymer resin material. The swing body B7 includes a concave central seat portion 310 defining recess R that forms a seat and a peripheral edge 312 surrounding the concave central portion 310. The seat defined by the concave central seat portion 310 is adapted to support an infant or a small child or can be dimensioned to support an adult. In one embodiment, the peripheral edge 312 of the body is circular such that the body defines a saucer or disk, although the peripheral edge can be polygonal or otherwise non-circular. In one embodiment, the body B7 has a diameter in the range of 22 inches to 40 inches, and the recess R has a maximum depth relative to the peripheral edge 12 in the range of 1 inch to 8 inches.

The peripheral edge 312 of the body B7 includes a plurality of tether openings O1, O2, O3, O4 with which the lower tethers LT1-LT4 are respectively engaged. In the illustrated embodiment, the peripheral edge 312 comprises at least four of the tether openings O1-O4 arranged symmetrically about the peripheral edge 12 such that the four tether openings O1-O4 are circumferentially spaced at 90 degree intervals from each other and such that each of said four tether openings are diametrically opposed from another one of the four tether openings, but the present development is not limited to the illustrated symmetrical arrangement of the tether openings O1-O4 which can be angularly spaced from each other by more or less than 90 degrees.

The concave central seat portion 310 includes a drain opening D defined therein for allowing water and dirt/sand to flow by gravity from the seat recess R through the drain opening D. The drain opening D is centrally located in the central seat portion 310 so as to be equidistant from each of said four tether openings O1-O4 and so as to be located at the deepest part of the recess R.

An upper surface US of the concave central seat portion 310 is smooth for maximum comfort for a user supported thereon and to facilitate flow or water and sand toward the drain opening D. The opposite lower surface LS of the concave central seat portion 310, which is located on an opposite side of the central seat portion 310 as compared to the upper surface US, preferably comprises a convexly curved surface or is otherwise shaped.

The peripheral edge 312 comprises: (i) a top wall 312*a* that extends radially outward from the outermost edge of the seat recess R; (ii) an outer circular wall 312*b* connected to and projecting downwardly from an outer end of the top wall 312*a*; and, (iii) an inner circular wall 312*c* connected to and projecting downwardly from an inner end of the top wall 312*a* such that the inner circular wall 312*c* is located radially inward from and is arranged concentrically with the outer circular wall 312*b*. As such, a peripheral groove 312*g* is defined between the outer and inner circular walls 312*b*, 312*c* (the illustrated embodiment includes a third circular wall or rib 313 concentrically located between the outer and inner circular walls 312*b*,312*c*). The tether openings O1-O4 are each defined in the top wall 312*a* and each open through the top wall 12*a* into the peripheral groove 312*g* defined between the outer and inner circular walls 312*b*,312*c*. The body B7 also includes a plurality of seat support ribs 330 that extend or project outward from the lower surface LS and that are arranged transversely relative to the outer and inner circular walls 312*b*,312*c*, with an outer end of each seat support rib 330 connected to the outer circular wall 312*b* and an inner end of each seat support rib 330 spaced inwardly from the inner circular wall 312*c*.

The body B7 differs from the body B in that at least part of the lower portion LT of the tether system T extends along and is located adjacent and support the lower surface LS of the seat portion 310 at a location spaced radially inward from the peripheral groove 312*g* to provide added support and structure to the seat portion 310 where the lower portion LT of the tether system T lies adjacent and beneath the lower surface LS. A first tether section TS1 (FIG. 18) extends between the first and second tether openings O1,O2 on a path that extends along and lies adjacent the lower surface LS of the seat portion 310 at a location spaced radially inward from the peripheral groove 312*g*, and a second tether section TS2 extends between the third and fourth tether openings O3,O4 on a path that extends along and lies adjacent the lower surface LS of the seat portion 310 at a location spaced radially inward from the peripheral groove 312*g*, such that both the first and second tether sections TS1,TS2 provide structural support for the seat portion 310. The first and second tether sections are adjacent the lower surface LS when they are in contact with and/or are located close to the lower surface LS.

More particularly, the body B7 differs from the body B in that it includes first and second parallel, spaced-apart tether grooves or channels C1,C2 that receive respective lengths or sections TS of the lower portion LT of the tether system T. Each tether channel C1,C2 is defined by parallel spaced-apart side walls S1,S2 and by the lower surface LS, such that each channel C1,C2 is open to receive a respective tether section TS1,TS2 (FIG. 18) of the tether system lower portion LT (only a portion of each tether section TS1,TS2 is shown to simplify the drawing). More particularly, the tether channel C1 is adapted to receive a first tether section TS1 of the tether system lower portion LT that extends between the first and second tether openings O1,O2 adjacent the lower surface LS. Similarly, the tether channel C2 is adapted to receive a second tether section TS2 of the tether system lower portion LT that extends between the third and fourth tether openings O3,O4 adjacent the lower surface LS. The first tether channel C1 at least partially defines a first path that extends between first and second ones of said tether openings O1,O2, and the second tether channel C2 at least partially defines a second path that extends between third and fourth ones of said tether openings O3,O4. As noted above, the lower portion LT of the tether system can comprise a continuous length of rope or other tether material, or can comprise two or more separate sections of rope and/or other tether material.

Figure 18:
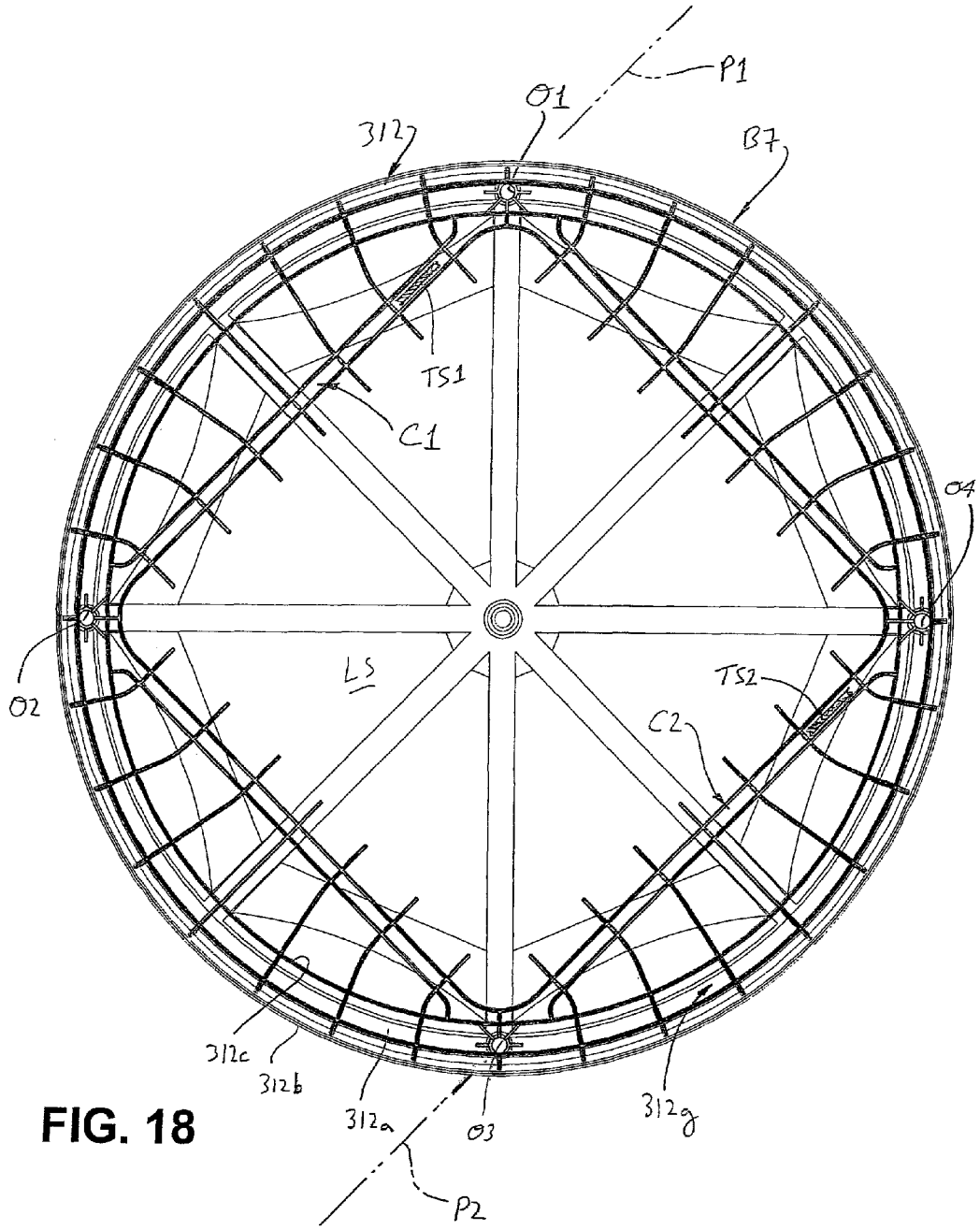
FIG. 18 is a bottom view of the swing body of FIG. 16.

As shown in FIG. 18, the first tether channel C1 lies in a first plane P1 that intersects the first and second tether openings O1,O2, and the second tether channel C2 lies in a second plane P2 that intersects the third and fourth tether openings O3,O4 and that is parallel to and spaced-apart from the first plane P1 in which the first tether channel lies. As such, the first tether section TS1 is located in the first tether channel C1 and extends between the first and second tether openings O1,O2 beneath and adjacent the lower surface LS on a first lateral side of the seat portion 310, and the second tether section TS2 is located in the second tether channel C2 and extends between the third and fourth tether openings O3,O4 beneath and adjacent the lower surface LS on a second lateral side of the seat portion 310. The inner circular wall 312*c* includes gaps G through which the tether sections pass to enter the channels C1,C2. Because the first and second tether sections TS1 are in contact with the lower surface LS and/or are in contact with structures of the swing body B7 that project from the lower surface LS, the first and second tether sections TS1,TS2 strengthen and support the seat portion 310 to provide enhanced durability. When the swing body B7 is operatively positioned, with its upper surface US oriented upward for supporting a user thereon, the lower surface is oriented downward and the first and second tether sections TS1,TS2 are located beneath the lower surface LS.

Figure 19:
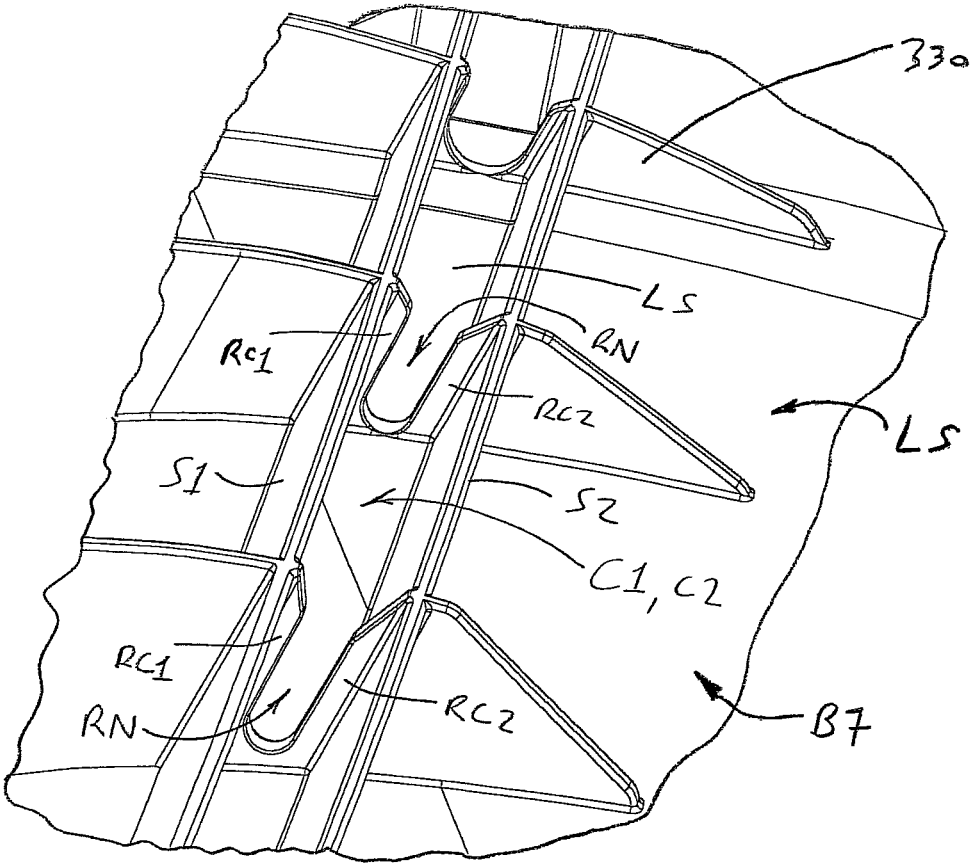
FIG. 19 is an enlarged partial isometric view of the swing body of FIG. 16 showing the structure of the first and second tether channels.

Each tether channel C1,C2 includes at least one and preferably a plurality of tether gripping structures for engaging the tether section TS1,TS2 located in the tether channels C1,C2 and preventing or at least inhibiting sliding movement of the tether section TS1,TS2 axially along the length of the channel C1,C2. In the illustrated embodiment, as seen in FIG. 19, the tether gripping structures are each provided by first and second channel ribs RC1,RC2 connected to and arranged transverse relative to the respective channel side walls S1,S2. The channel ribs RC1,RC2 are aligned with each other on opposite sides of the channel C1,C2 such that a tether retaining notch RN is defined between the first and second channel ribs RC1,RC2. The notch RN defines a width, measured as close to the lower surface LS as possible, that is that is less than the diameter of the rope or other tether material being used to define each tether section TS1,TS2 such that the tether section TS1,TS2 is pinched between the channel ribs RC1,RC2 when the tether section is installed in the channel C1,C2. When the tether section TS1,TS2 is pinched in the notch RN defined between first and second aligned channel ribs RC1,RC2, the tether section TS1,TS2 is restrained from any axial sliding movement along the length of the channel C1,C2, especially when multiple such tether griping structures are including in each channel C1,C2 as provided in the illustrated embodiment. An adhesive such as a hot-melt adhesive or the like can also be used to secure each tether section TS1,TS2 in its respective tether channel C1,C2, e.g., by applying the adhesive at the interface of the tether section TS1,TS2 and at least one of the notches RN where the tether section is pinched between the channel ribs RC1,RC2 and/or by applying the adhesive elsewhere in the channel C1,C2 in contact with the tether section TS1,TS2. As also shown in the illustrated embodiment, the first and second channel ribs RC1,RC2 can be provided together as a one-piece structure with the notch RN defined therein. The tether retaining notches RN located in the first tether channel C1 are referred to as first tether retaining structures or notches and the tether retaining notches RN located in the second tether channel C2 are referred to as second tether retaining structures or notches.

In the illustrated embodiment, the tether channels C1,C2 lie in the respective parallel spaced-apart planes P1,P2, such that the tether sections TS1,TS2 also lie in these planes, respectively. In an alternative embodiment, the tether channel C1',C2 follows a curved path that deviates from the respective plane P1,P2 as the channel C1,C2 extends across the lower surface LS. In both cases, however, the first tether section TS1 extends between the first and second tether openings O1,O2 on a path that lies at least partially under and adjacent the lower surface LS of the seat portion 310 at a location spaced radially inward from the peripheral groove 312*g* in contact with the body B7 in the region of the lower surface LS, and the second tether section TS2 extends between the third and fourth tether openings O3,O4 on a path that lies at least partially under and adjacent the lower surface LS of the seat portion 310 at a location spaced radially inward from the peripheral groove 312*g* in contact with the body B7 in the region of the lower surface LS, such that both the first and second tether sections TS1,TS2 provide structural support for the seat portion 310.

The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. A swing comprising:

a one-piece polymeric body including a concave central portion defining a recessed seat and a peripheral edge surrounding the concave central portion;

first, second, third, and fourth tether openings located in said body;

a tether system adapted to suspend the body from an associated support member, said tether system comprising first, second, third, and fourth lower tethers respectively engaged with said first, second, third and fourth tether openings;

wherein said first and second lower tethers are defined by a first rope portion that extends between and through the first and second tether openings and said third and fourth lower tethers are defined by a second rope portion that extends between and through the third and fourth tether openings;

said body further comprising first and second groove regions, wherein said first rope portion that defines said first and second lower tethers extends in said first groove region and said second rope portion that defines said third and fourth lower tethers extends in said second groove region.

2. The swing as set forth in claim 1, wherein said peripheral edge comprises a top wall that extends outwardly from the concave central portion.

3. The swing as set forth in claim 2, wherein said body further comprises an outer wall connected to and extending downwardly from the top wall.

4. The swing as set forth in claim 3, wherein said first, second, third, and fourth tether openings are each located in said top wall.

5. The swing as set forth in claim 4, further comprising a plurality of peripheral edge support ribs connected to the outer wall.

6. The swing as set forth in claim 5, wherein said concave central portion comprises an upper surface and an opposite lower surface, said swing further comprising a plurality of seat support ribs projecting from the lower surface of the concave central portion.

7. The swing as set forth in claim 6, wherein the seat support ribs each extend radially outward from an inner end to an outer end.

8. The swing as set forth in claim 7, wherein the seat support ribs are aligned with respective peripheral edge support ribs.

9. The swing as set forth in claim 3, wherein said outer wall is circular and said swing further comprises an inner circular wall located radially inward from and arranged concentrically relative to said outer wall.

10. The swing as set forth in claim 9, wherein said peripheral edge support ribs extend between and connect the inner circular wall and the outer circular wall.

11. A swing comprising:

a one-piece polymeric body including a concave central seat portion including an upper surface and an opposite lower surface, said body further comprising a peripheral edge surrounding the concave central seat portion;

said peripheral edge comprising: (i) a top wall that extends outwardly from the concave central seat portion; and, (ii) an outer wall connected to an outer end of the top wall;

wherein said body defines a peripheral groove under the top wall adjacent the outer wall, said peripheral groove located between the top wall, the outer wall, and the lower surface of the concave central seat portion;

first, second, third, and fourth tether openings located in said body;

a tether system adapted to suspend the body from an associated support member, said tether system comprising: (i) first and second lower tethers defined by a first rope portion that extends between and through the first and second tether openings; and, (ii) third and fourth lower tethers defined by a second rope portion that extends between and through the third and fourth tether openings.

12. The swing as set forth in claim 11, wherein said first, second, third, and fourth tether openings are each located in said top wall.

13. The swing as set forth in claim 12, further comprising a plurality of peripheral edge support ribs connected to the outer wall.

14. The swing as set forth in claim 13, further comprising a plurality of seat support ribs projecting from the lower surface of the concave central seat portion.

15. The swing as set forth in claim 14, wherein the seat support ribs each extend radially outward from an inner end to an outer end.

16. The swing as set forth in claim 15, wherein each seat support rib is aligned with a respective peripheral edge support rib.

17. The swing as set forth in claim 13, further comprising an inner circular wall located radially inward from said outer wall.

18. The swing as set forth in claim 17, wherein said outer wall is circular and said inner circular wall is concentrically arranged relative to the outer wall.

19. The swing as set forth in claim 13, wherein said first rope portion extends into said peripheral groove through both said first and second tether openings, and wherein said second rope portion extends into said peripheral groove through both said third and fourth tether openings.

20. The swing as set forth in claim 11, wherein said first rope portion extends into said peripheral groove through both said first and second tether openings, and wherein said second rope portion extends into said peripheral groove through both said third and fourth tether openings.

* * * * *